US010349723B2

(12) United States Patent
Kim

(10) Patent No.: US 10,349,723 B2
(45) Date of Patent: Jul. 16, 2019

(54) COMPACT COSMETICS CONTAINER HAVING OPENING/CLOSING BUTTON FORMED IN LID THEREOF

(71) Applicant: AMOREPACIFIC CORPORATION, Seoul (KR)

(72) Inventor: Jun Young Kim, Seoul (KR)

(73) Assignee: AMOREPACIFIC CORPORATION, Seoul (KR)

( * ) Notice: Subject to any disclaimer, the term of this patent is extended or adjusted under 35 U.S.C. 154(b) by 184 days.

(21) Appl. No.: 15/528,582

(22) PCT Filed: Nov. 20, 2015

(86) PCT No.: PCT/KR2015/012522
§ 371 (c)(1),
(2) Date: May 22, 2017

(87) PCT Pub. No.: WO2016/085202
PCT Pub. Date: Jun. 2, 2016

(65) Prior Publication Data

US 2017/0273440 A1 Sep. 28, 2017

(30) Foreign Application Priority Data

Nov. 24, 2014 (KR) ..... 10-2014-0164121

(51) Int. Cl.
*A45C 13/10* (2006.01)
*A45D 40/22* (2006.01)
(Continued)

(52) U.S. Cl.
CPC ..... *A45D 40/222* (2013.01); *A45D 33/00* (2013.01); *A45D 40/00* (2013.01); *A45D 40/22* (2013.01);
(Continued)

(58) Field of Classification Search
CPC ..... A45D 40/222; A45D 2040/227; A45D 2040/223; A45D 2040/224; A45D 33/22; A45D 33/24; A45D 33/00
See application file for complete search history.

(56) References Cited

U.S. PATENT DOCUMENTS 7,140,372 B2 * 11/2006 Byun ..... A45D 33/20 132/287
7,753,228 B2 * 7/2010 Yuhara ..... A45D 33/006 220/4.22
(Continued)

FOREIGN PATENT DOCUMENTS

JP 2008-054839 A 3/2008
JP 2014-018537 A 2/2014
(Continued)

*Primary Examiner* — Jeffrey R Allen
(74) *Attorney, Agent, or Firm* — Heedong Chae; Lucem, PC

(57) ABSTRACT

The present invention relates to a compact cosmetics container having an opening/closing button formed in a container lid so that it is possible to eliminate the receiving space that the opening/closing button occupies in the container body and remove an intermediate container required for assembling the opening/closing button, whereby the cosmetics receiving space of the container body can be maximized to effectively accommodate more cosmetics therein, thereby minimizing the inconvenience of frequently refilling cosmetics; and an opening/closing tension member made of a rubber material is formed in the opening/closing button such that when the opening/closing button is pressed, the locking protrusion of the opening/closing button is released from the locking recess of the container body, and a lid lifting resilient part of the opening/closing tension member resiliently presses the upper end surface of the container body to push the container lid upward, thereby opening the container lid.

5 Claims, 9 Drawing Sheets

(51) Int. Cl.

| | |
|---|---|
| ***A45D 40/00*** | (2006.01) |
| ***B65D 43/26*** | (2006.01) |
| ***A45D 33/00*** | (2006.01) |

(52) U.S. Cl.

CPC ..... *A45D 40/221* (2013.01); *B65D 43/26* (2013.01); *A45C 13/1084* (2013.01); *A45D 2040/223* (2013.01); *A45D 2040/227* (2013.01)

(56) References Cited

U.S. PATENT DOCUMENTS

| | | | | |
|---|---|---|---|---|
| 8,006,706 | B2 * | 8/2011 | Sekine ..... | A45D 40/221<br>132/293 |
| 8,177,091 | B2 * | 5/2012 | Kearney, II ..... | A45D 40/222<br>132/293 |

FOREIGN PATENT DOCUMENTS

| | | | |
|---|---|---|---|
| KR | 20-0171448 | Y1 | 4/2000 |
| KR | 10-285335 | B1 | 7/2013 |
| KR | 10-1390289 | B1 | 4/2014 |

* cited by examiner

COMPACT COSMETICS CONTAINER HAVING OPENING/CLOSING BUTTON FORMED IN LID THEREOF

CROSS-REFERENCE TO RELATED APPLICATION

This application claims the benefit of Korean application No. 10-2014-0164121, filed on Nov. 24 2014 with the Korean Intellectual Property Office, the disclosure of which is incorporated herein by reference.

TECHNICAL FIELD

The present invention relates to a compact cosmetics container having an opening/closing button formed in a lid thereof and, more specifically, to a compact cosmetics container having an opening/closing button formed in a lid thereof, in which the opening/closing button is formed in the container lid so that it is possible to eliminate the receiving space that the opening/closing button occupies in the container body and remove an intermediate container required for assembling the opening/closing button, whereby the cosmetics receiving space of the container body can be maximized to effectively accommodate more cosmetics therein, thereby minimizing the inconvenience of frequently refilling cosmetics; and an opening/closing tension member made of a rubber material is formed in the opening/closing button, which is formed in the container lid, such that when the opening/closing button is pressed, the locking protrusion of the opening/closing button is released from the locking recess of the container body, and a lid lifting resilient part of the opening/closing tension member resiliently presses the upper end surface of the container body to push the container lid upward, thereby opening the container lid.

BACKGROUND ART

Color cosmetics, which are used to beautifully adorn the skin of a user by making the appearance beautiful, are classified into a base makeup used for making a skin color uniform and capping a defect and a point makeup used for partially enhancing a three-dimensional effect of a lip, eyes, or nails. The base makeup includes a makeup base, a foundation and a powder, and the point makeup includes a lipstick, an eye liner, and mascara.

The foundation is classified into solid-type foundation, liquid-type foundation and gel-type foundation according to a type of cosmetic contents. In case of the solid-type foundation, although the solid-type foundation has a good cover effect, the makeup is united when the makeup is refreshed. In case of the liquid-type foundation, although the liquid-type foundation gives a good close contact feel, the persistency is weak. Thus, in recent years, the number of customers favoring the gel-type foundation having a considerable persistency and a good close contact feel has been increased.

Therefore, there is need to develop a container for gel-type foundation. Generally, the gel-type foundation, which is filled into a glass container or a tub-type container, is used in such a manner that a user takes some foundation on his hands for use or squeezes foundation from the container and then, coats the foundation on his skin by using a puff or his hands.

However, according to the related art, since a user gets cosmetics on his hands every time that it is used, it is inconvenient to wash hands every time after use. In addition, as the hands coated with cosmetics are washed, the cosmetics are wasted.

To solve the above problems, there has been developed a compact container in which a puff is kept and which allows a user to make it easier to carry cosmetics without getting into hands.

However, the compact container according to the related art has a structure in which the lid and the container body are forcibly detached from each other, so that it is inconvenient for a user to open or close the lid to use cosmetics. In addition, the coupling structure of the compact container is strained due to the repetitive forced attachment and detachment, so that the coupling structure is worn out or damaged. Thus, it is difficult to use the compact the compact container for a long time.

To solve the above problems, as shown in FIG. 1, a compact container with en opening/closing button is disclosed in Korean Registered Utility Model No. 20-0171448, where the compact container with an opening/closing button includes a lid 2 and a hook 4 integrally formed with the lid 2. The opening/closing button 3 elastically operable to open or close the lid 2 is formed on a container body 1. When a push portion of the opening/closing button 3 protruding outwardly from the container body 1 is pressed, the engagement between a hook of the opening/closing button 3 and the hook 4 formed on the lid 2 is released so that the lid 2 is opened.

However, according to the related art described above, since the opening/closing button 3 is installed to the container body 1 and the opening/closing button 3 is covered with an intermediate container 5 so that the space required for forming the opening/closing button 3 is large, the amount of the cosmetic material contained in the container body 1 is reduced so that the cosmetic container is required to be frequently refilled with the cosmetic material. Therefore, there is a need to develop a container capable of efficiently containing a large amount of cosmetics by minimizing the volume occupied by of the opening/closing button 2 in the container body 1.

DISCLOSURE

[Technical Problem]

To solve the problems described above, an object of the present invention is to provide a compact cosmetics container having an opening/closing button formed in a lid thereof, in which the opening/closing button is formed in the container lid so that it is possible to eliminate the receiving space that the opening/closing button occupies in the container body and remove an intermediate container required for assembling the opening/closing button, whereby the cosmetics receiving space of the container body can be maximized to effectively accommodate more cosmetics therein, thereby minimizing the inconvenience of frequently refilling cosmetics.

In addition, another object of the present invention is to provide a compact cosmetics container having an opening/closing button formed in a lid thereof, in which an opening/closing tension member made of a rubber material is formed in the opening/closing button, which is formed in the container lid, such that when the opening/closing button is pressed, the locking protrusion of the opening/closing button is released from the locking recess of the container body, and a lid lifting resilient part of the opening/closing tension member resiliently presses the upper end surface of the container body to push the container lid upward, thereby opening the container lid.

[Technical Solution]

According the present invention, there is provided a compact cosmetics container having an opening/closing button formed in a lid thereof, which includes:

a container body (10) formed on one side thereof with a locking recess (11);

a container lid (20) coupled to the container body (10) and formed at one side thereof with a receiving recess (21);

an opening/closing button (30) installed in the receiving recess (21) of the container lid (20) and formed with an installing recess (33);

an opening/closing tension member (40) formed of a rubber material and installed in the installing recess (33) of the opening/closing button (30), wherein the opening/closing button (30) is integrally formed at a center of a lower side thereof with a locking protrusion (31), the locking protrusion (31) is coupled to the locking recess (11) of the container body (10), and the opening/closing tension member (40) includes an opening/closing resilient part (41) for resiliently pressing a front surface of the receiving recess (21) of the container lid (20), and a lid lifting resilient part (42) for resiliently pressing an upper end surface of the container body (10).

In addition, a coupling recess (22) may be formed on a side surface of the receiving recess (21), and coupling protrusions (32) formed on both side surfaces of the opening/closing button (30) are rotatably coupled to the coupling recess (22).

The opening/closing tension member (40) may be formed of an elastic rubber material which includes at least one of natural rubber, elastomer, acrylonitrile-butadiene rubber (NBR), and silicon rubber.

The opening/closing resilient part (41) may protrude toward an inner surface of the opening/closing button (30).

The lid lifting resilient part (42) may protrude downwardly of the opening/closing button (30).

[Advantageous Effects]

According to the compact cosmetics container having an opening/closing button formed in a lid thereof of the present invention, the opening/closing button is formed in the container lid so that it is possible to eliminate the receiving space that the opening/closing button occupies in the container body and to remove an intermediate container required for assembling the opening/closing button, whereby the cosmetics receiving space of the container body can be maximized to effectively accommodate more cosmetics therein, thereby minimizing the inconvenience of frequently refilling cosmetics.

In addition, the opening/closing tension member made of a rubber material is formed in the opening/closing button, which is formed in the container lid, such that when the opening/closing button is pressed, the locking protrusion of the opening/closing button is released from the locking recess of the container body, and a lid lifting resilient part of the opening/closing tension member resiliently presses the upper end surface of the container body to push the container lid upward, thereby opening the container lid.

BEST MODE

[Mode for Invention]

Hereinafter, a compact cosmetics container having an opening/closing button formed in a lid thereof according to the present invention will be described with reference to accompanying drawings.

Figure 2:
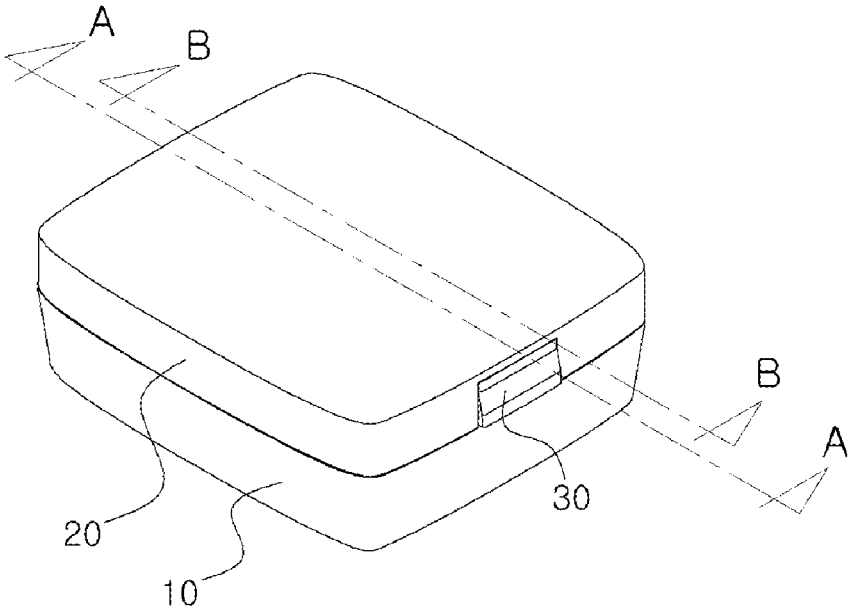
FIG. 2 is a perspective view showing a compact cosmetics container having an opening/closing button formed in a lid thereof according to the embodiment of the present invention.
Figure 3:
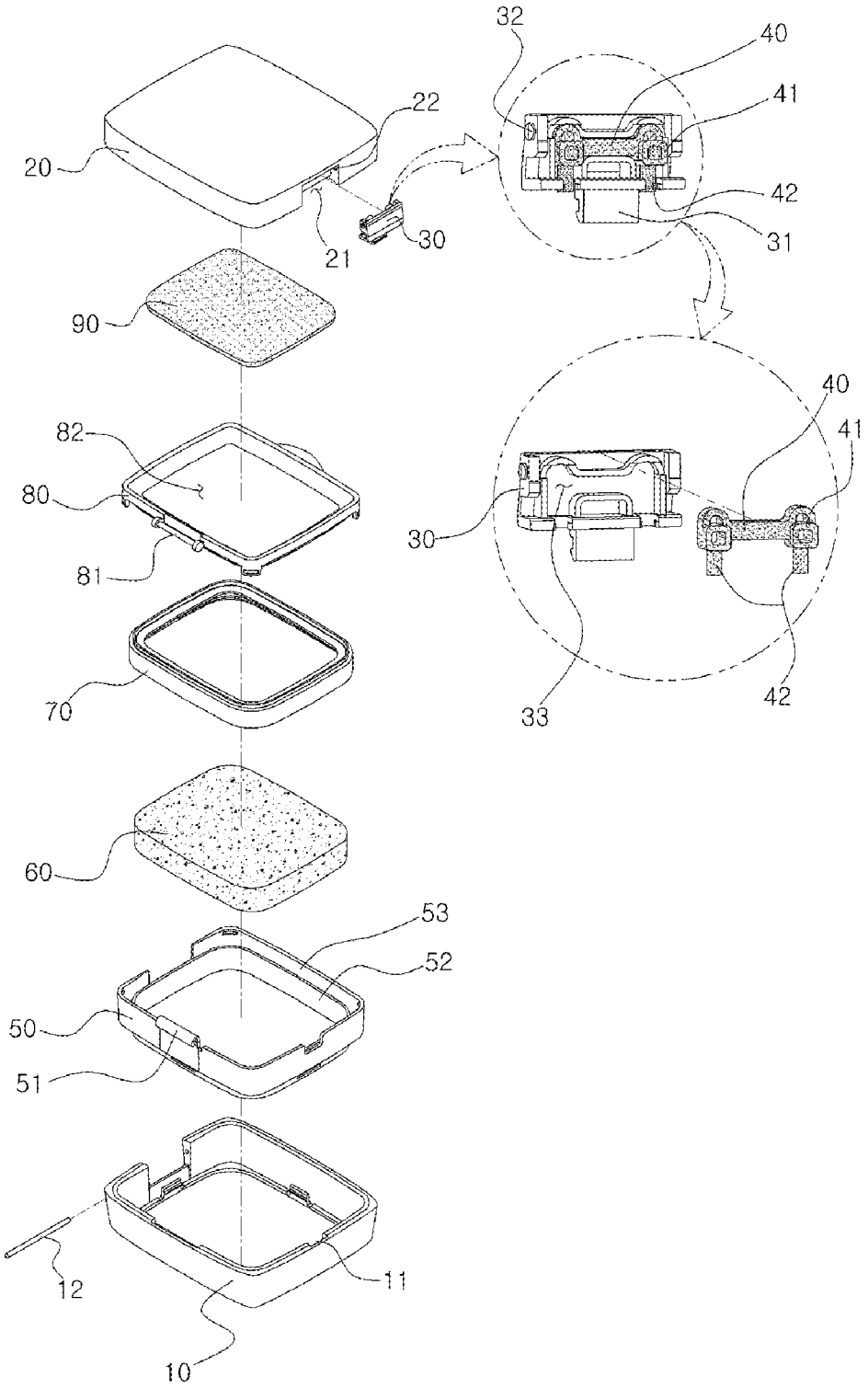
FIG. 3 is an exploded perspective view showing a compact cosmetics container having an opening/closing button formed in a lid thereof according to an embodiment of the present invention.
Figure 4:
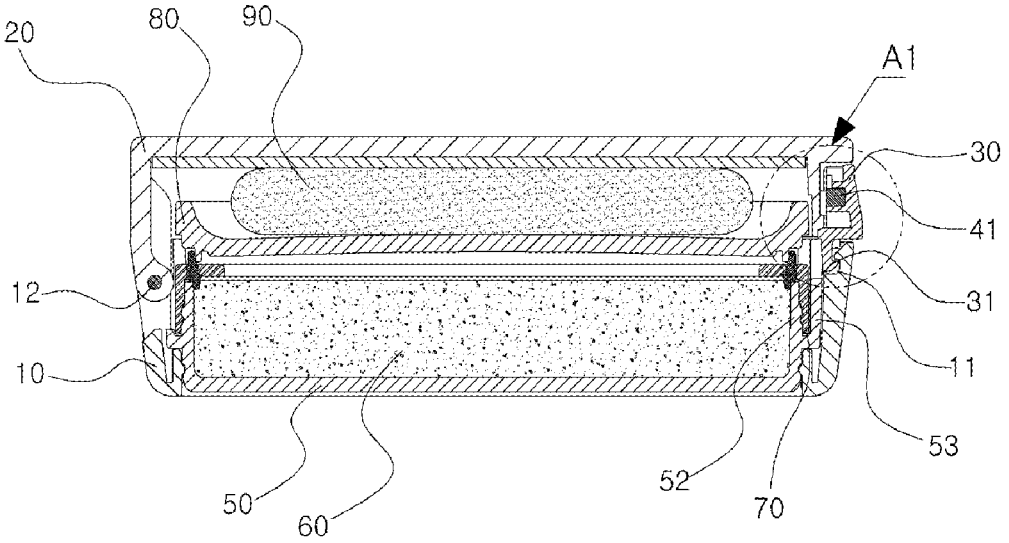
FIG. 4 is a sectional view taken along line A-A of FIG. 2.
Figure 5:
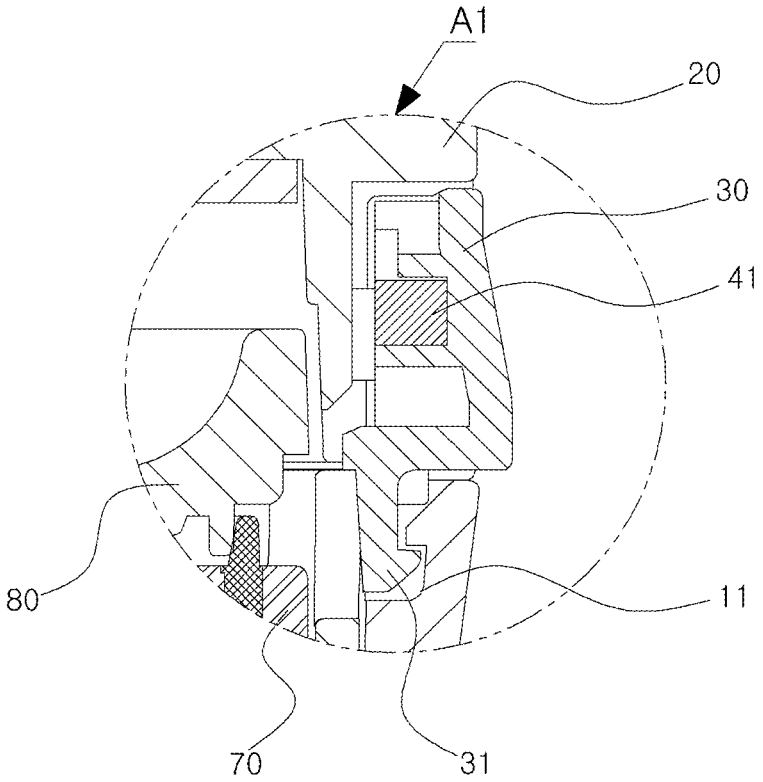
FIG. 5 is an enlarged view of portion 'A1' of FIG. 4.
Figure 6:
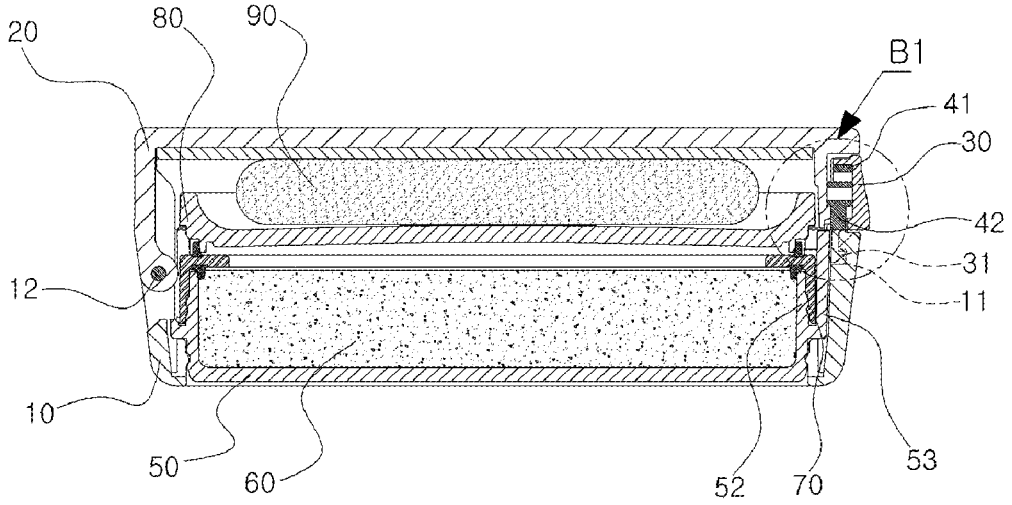
FIG. 6 is a sectional view taken along line B-B of FIG. 2.
Figure 7:
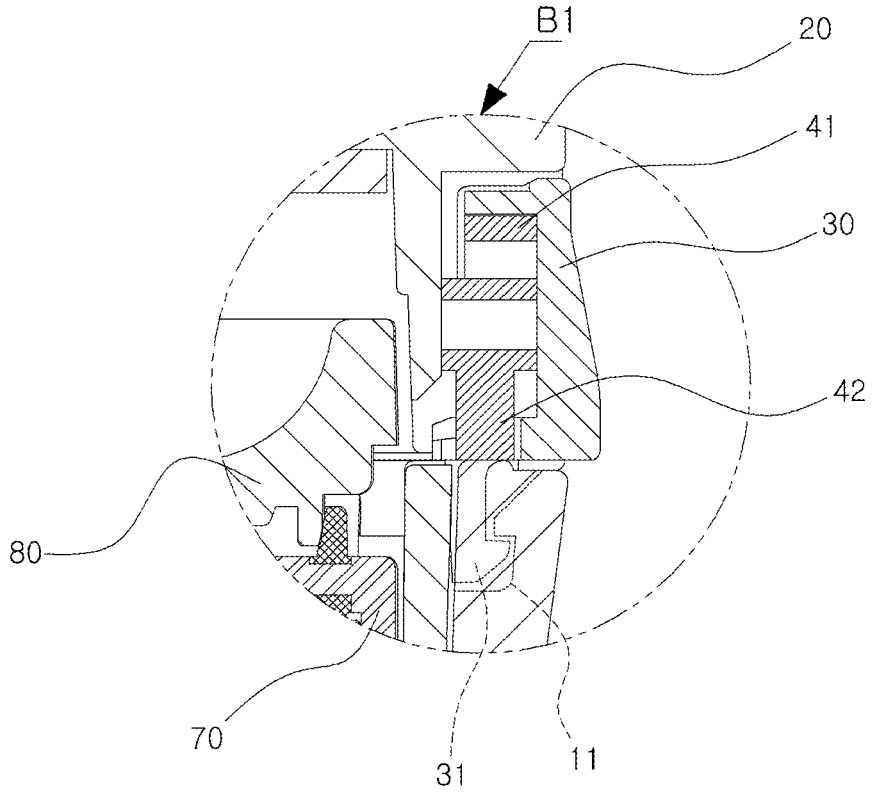
FIG. 7 is an enlarged view of portion 'B1' of FIG. 6.
Figure 8:
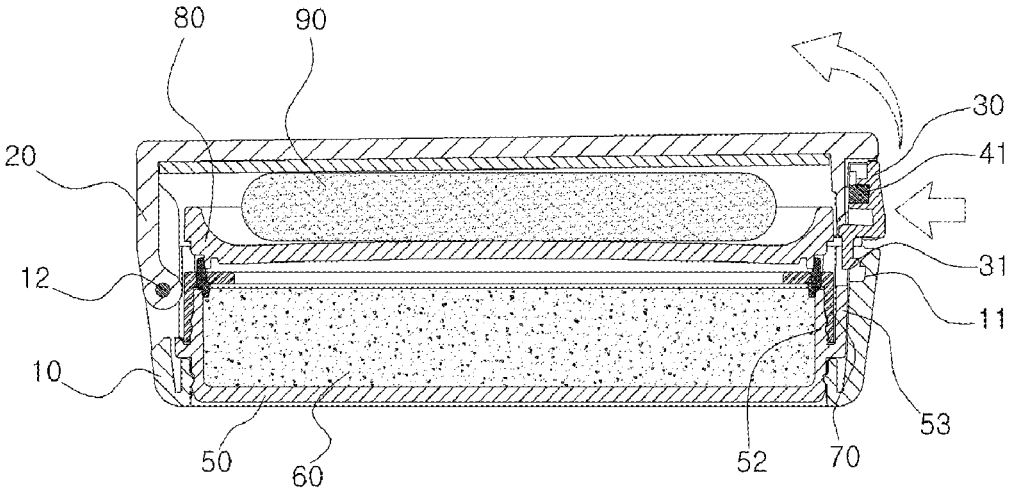
FIG. 8 is a sectional view showing a state in which an opening/closing button of a compact cosmetics container having an opening/closing button formed in a lid thereof according to an embodiment of the present invention is pushed.
Figure 9:
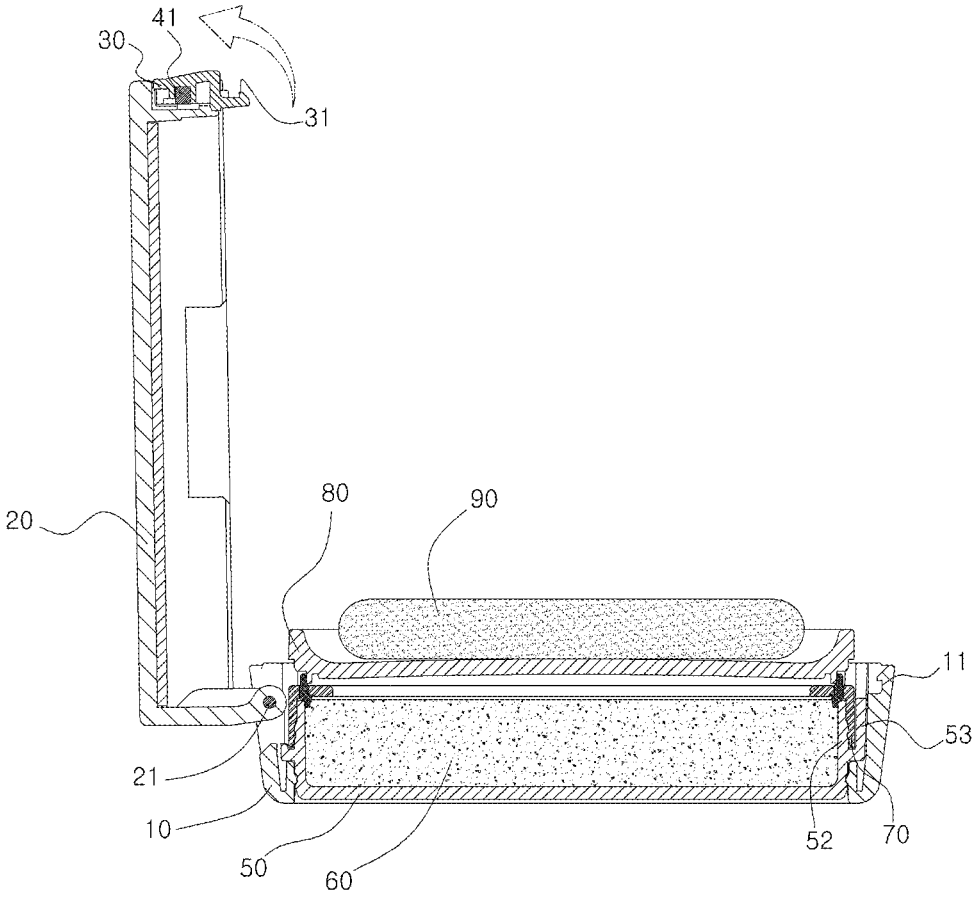
FIG. 9 is a sectional view showing a state in which a container lid of a compact cosmetics container having an opening/closing button formed in a lid thereof according to an embodiment of the present invention is opened.

FIG. 2 is a perspective view showing a compact cosmetics container having an opening/closing button formed in a lid thereof according to an embodiment of the present invention. FIG. 3 is an exploded perspective view showing a compact cosmetics container having an opening/closing button formed in a lid thereof according to an embodiment of the present invention. FIG. 4 is a sectional view taken along line A-A of FIG. 2. FIG. 5 is in enlarged view of portion 'A1' of FIG. 4. FIG. 6 is a sectional view taken along line B-B of FIG. 2. FIG. 7 is an enlarged view of portion 'B1' of FIG. 6. FIG. 8 is a sectional view showing a state in which an opening/closing button of a compact cosmetics container having an opening/closing button formed in a lid thereof according to a embodiment of the present invention is pushed. FIG. 9 is a sectional view showing a state in which a container lid of a compact cosmetics container having an opening/closing button formed in a lid thereof according to an embodiment of the present invention is opened.

A compact cosmetics container having an opening/closing button formed in a lid thereof according to the present invention includes a container body 10 formed on one side thereof with a locking recess 11, a container lid 20 coupled to the container body 10 and formed at one side thereof with a receiving recess 21, an opening/closing button 30 installed in the receiving recess 21 of the container lid 20 and formed with an installing recess 33, an opening/closing tension member 40 formed of a rubber material and installed in the installing recess 33 of the opening/closing button 30, wherein the opening/closing button 30 is integrally formed at a center of a lower side thereof with a locking protrusion 31, the locking protrusion 31 is coupled to the locking recess 11 of the container body 10, and the opening/closing tension member 40 includes an opening/closing resilient part 41 for resiliently pressing a front surface of the receiving recess 21 of the container lid 20, and a lid lifting resilient part 42 for resiliently pressing an upper end surface of the container body 10.

The container body 10 receives an intermediate inner container 50. The locking recess 11 is formed on one side of the container body 10. A hinge is formed at a side opposite to the locking groove 11 such that the container lid 20 is hinge-coupled to the container body 10 with a hinge pin 12.

The container lid 20, which covers an upper portion of the container body 10, is hinge-coupled to the container body 10 to open or close the container body 10.

The receiving recess 21 is formed on one side of the container lid 20 and a coupling recess 22 is formed on a side surface of the receiving recess 21.

The opening/closing button 30 is installed in the receiving recess 21 and is coupled to the locking recess 11 of the container body 10.

A coupling protrusion 32 which is formed on both side surfaces of the opening/closing button 30 is rotatably filled into the coupling recess 22.

The locking protrusion 31 is formed on the center of a lower side of the opening/closing button 30 and a coupling protrusion 32 is formed on both side surface of the opening/closing button 30. The installing recess 33 is formed on a rear surface of the opening/closing button 30 such that the opening/closing tension member 40 is installed in the installing recess 33.

The locking protrusion 31 is formed in a protrusion shape such that the locking protrusion 31 may be latched into the locking recess 11 of the container body 10.

The coupling protrusion 32 is rotatably coupled into the coupling recess 22 of the container lid 20, such that the opening/closing button 30 is prevented from being separated from the container lid 20.

Figure 1:
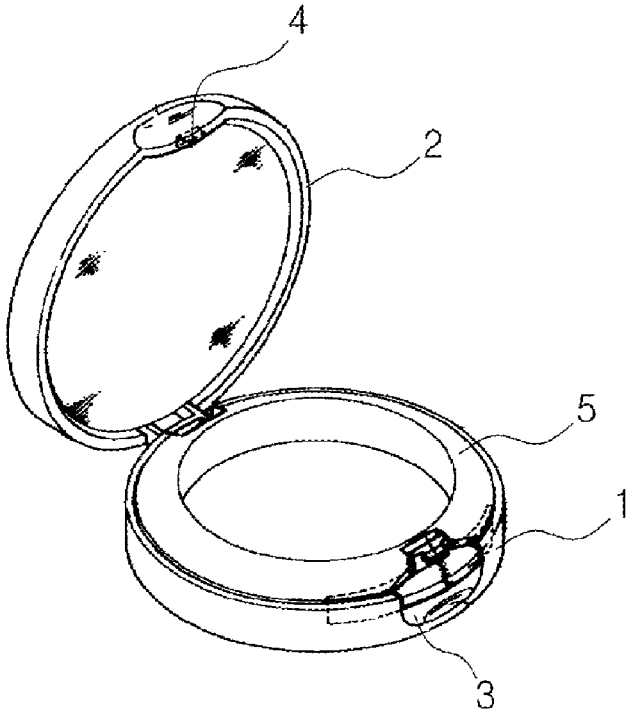
FIG. 1 is a perspective view showing a compact container according to the related art.

The opening/closing button 30 formed in the container lid enables the receiving space, which is occupied in the container body 1 by the opening/closing button 3 according to the related art as shown in FIG. 1, to be eliminated and the intermediate container required for assembling the opening/closing button 3 to be removed, so that the cosmetic material receiving space of the container body 1 may be maximized to be effectively filled with more cosmetics, thereby minimizing the inconvenience of frequently refilling cosmetics.

Since the opening/closing tension member 40 installed in the installing recess 33 on the inner surface of the opening/closing button 30 must elastically support the opening/closing button 30, the opening/closing tension member 40 is formed of an elastic rubber material which includes at least one of natural rubber, elastomer, acrylonitrile-butadiene rubber (NBR), and silicon rubber.

The opening/closing tension member 40 includes an opening/closing resilient part 41 and a lid lifting resilient part 42.

The opening/closing resilient part 41 protrudes from an inner surface of the opening/closing button 30. As shown in FIGS. 4 to 7, the opening/closing resilient part 41 resiliently presses a front surface of the receiving recess 21 of the container lid 20 such that the locking protrusion 31 of the opening/closing button 30 is coupled into the locking recess 11 of the container body 10.

The lid lifting resilient part 42 protrudes downwardly of the opening/closing button 30 and elastically presses an upper end surface of the container body 10.

When the opening/closing button 30 is pressed, the coupling protrusion 31 is released from the locking recess 11. In this case, since the lid lifting resilient part 42 resiliently presses the upper end surface of the container body 10, the container lid 20 is opened while lifting up.

The inner container 50 is installed inside the container body 10 and is integrally formed on one side of an upper portion thereof with a hinge hook 51. An outer wall 53 is formed outside an inner wall 52 while be spaced apart from the inner wall 52 by a predetermined interval.

A cosmetic material may be directly contained in the inner container 50, or an impregnating member 60 impregnated with the cosmetic material may be installed in the inner container 50.

The hinge hook 51 is fastened to a hinge protrusion 81 formed on one side of an outer peripheral surface of the inner container lid 80 in a hook latch scheme.

A fixing member 70 is further coupled to an outer peripheral surface of the inner wall 52. The fixing member 70 is under-cut or screw coupled or fitted on an outer peripheral surface of the inner wall 52 of the inner container 50.

The inner container lid is coupled to the inner container 50 to open or close the inner container 50.

The inner container lid 80 is formed on one side of an outer peripheral surface thereof with the hinge protrusion 81 and is formed on upper side thereof with a puff containing portion 82 capable of keeping a puff 90.

The hinge protrusion 81 is coupled to the hinge hook 51, which is formed on one side of an upper portion of the inner container 50, in a hook latch scheme, so that the inner container lid 80 and the inner container 50 are not fixed with a pin but coupled to each other in the hook latch scheme. Thus, the number of components required for manufacture is reduced so that the manufacturing costing may be reduced.

The puff 90 is kept in the puff containing portion 82 to easily get the cosmetic material contained in the inner container 50 for use.

A method of assembling the compact cosmetics container having an opening/closing button formed in a lid thereof according to an embodiment of the present invention and the using state thereof will be described in detail as follows.

To assemble the compact cosmetics container having an opening/closing button formed in a lid thereof according to an embodiment of the present invention, the container lid 20 is hinge coupled to the container body 10 integrally formed one side thereof with the locking recess 11.

In this case, the receiving recess 21 is formed on one side of the container lid 20 and the coupling recess 22 is formed on the side surface of the receiving recess 21. The opening/closing button 30 is installed in the receiving recess 21 and the coupling protrusion 32 formed on both side surface of the opening/closing button 30 is rotatably inserted into the coupling recess 22.

The opening/closing tension member 40 including the opening/closing resilient part 41 and the lid lifting resilient part 42 is installed in the installing recess 33 of the opening/closing button 30.

Since the opening/closing tension member 40 elastically supports the opening/closing button 30, the opening/closing tension member 40 is formed of an elastic rubber material which includes at least one of natural rubber, elastomer, acrylonitrile-butadiene rubber (NBR), and silicon rubber.

Then, the inner container 50 is installed into the container body 10. The hinge hook 51 is formed on one side of the inner container 50. The hinge hook 51 is coupled with the hinge protrusion 81 formed on one side of the outer peripheral surface of the inner container lid 80 in a hook latch scheme, so that the inner container lid 80 and the inner container 50 are coupled to each other.

The cosmetic material may be directly contained in the inner container 50, or the impregnating member 60 impregnated with the cosmetic material may be installed in the inner container 50.

The fixing member 70 is further coupled to the outer peripheral surface of the inner wall 52 of the inner container 50, so that the assembly of the compact cosmetics container having an opening/closing button formed in a lid thereof is completed.

As shown in FIG. 8, to use the compact cosmetics container having an opening/closing button formed in a lid thereof assembled in the above-described method, the opening/closing button 30 formed one side of the container lid 20 is pushed.

The opening/closing tension member 40 installed into the installing recess 33 of the opening/closing button 30 elastically supports the opening/closing button 30.

The lid lifting resilient part 42 of the opening/closing tension member 40 protrude downwardly of the opening/closing button 30. When the upper end surface of the container body 10 is pressed and the locking protrusion 31 of the opening/closing button 30 is released from the locking recess 11 of the container body 10, the lid lifting resilient part 42 of the opening/closing tension member 40 elastically presses the upper end surface of the container body 10, so that the container lid 20 is opened while lifting up.

As described above, the compact cosmetics container having an opening/closing button formed in a lid thereof described in this disclosure is an illustrative purpose only, and the present invention is not limited thereto. Thus, it should be understood that numerous other modifications and embodiments can be devised by these skilled in the art within the spirit and scope of the present invention and they will fall within the scope of the present invention.

DESCRIPTION OF REFERENCE NUMERAL

10: Container body
11: Locking recess
12: Hinge pin
20: Container lid
21: Receiving recess
22: Coupling recess
30: Opening/closing button
31: Locking protrusion
32: Coupling protrusion
33: Installing recess
40: Opening/closing tension member
41: Opening/closing resilient part
42: Lid lifting resilient part
50: Inner container
51: Hinge hook
52: Inner wall
53: Outer wail
60: Impregnating member
70: Fixing member
80: Inner container lid
81: Hinge Protrusion
82: Puff containing part
90: Puff

The invention claimed is:

1. A compact cosmetics container having an opening/closing button formed in a lid thereof, the compact cosmetics container comprising:

a container body (10) formed on one side thereof with a locking recess (11);

a container lid (20) coupled to the container body (10) and formed at one side thereof with a receiving recess (21);

an opening/closing button (30) installed in the receiving recess (21) of the container lid (20) and formed with an installing recess (33);

an opening/closing tension member (40) formed of a rubber material and installed in the installing recess (33) of the opening/closing button (30), wherein the opening/closing button (30) is integrally formed at a center of a lower side thereof with a locking protrusion (31), the locking protrusion (31) is coupled to the locking recess (11) of the container body (10), and the opening/closing tension member (40) includes an opening/closing resilient part (41) for resiliently pressing a front surface of the receiving recess (21) of the container lid (20), and a lid lifting resilient part (42) for resiliently pressing an upper end surface of the container body (10).

2. The compact cosmetics container of claim 1, wherein a coupling recess (22) is formed on a side surface of the receiving recess (21), and a coupling protrusion formed on a side surface of the opening/closing button (30) is rotatably coupled to the coupling recess (22).

3. The compact cosmetics container of claim 1, wherein the opening/closing tension member (40) is formed of an elastic rubber material which includes at least one of natural rubber, elastomer, acrylonitrile-butadiene rubber (NBR), and silicon rubber.

4. The compact cosmetics container of claim 1, wherein the opening/closing resilient part (41) protrudes toward an inner surface of the opening/closing button (30).

5. The compact cosmetics container of claim 1, wherein the lid lifting resilient part (42) protrudes downwardly of the opening/closing button (30).

* * * * *